United States Patent [19]

Prost

[11] 4,120,421

[45] Oct. 17, 1978

[54] CONTAINERS FOR CRYOGENIC LIQUIDS

[75] Inventor: Roger Prost, Saint Egreve, France

[73] Assignee: L'Air Liquide, Societe Anonyme pour l'Etude et l'Exploitation des Procedes Georges Claude, Paris, France

[21] Appl. No.: 777,934

[22] Filed: Mar. 15, 1977

[30] Foreign Application Priority Data

Mar. 25, 1976 [FR] France ..... 76 08651

[51] Int. Cl.[2] ..... B65D 25/18; F17C 13/00

[52] U.S. Cl. ..... 220/423; 220/446; 220/452

[58] Field of Search ..... 220/9 C, 9 D, 9 LG, 220/10, 14, 15

[56] References Cited

U.S. PATENT DOCUMENTS

| | | | |
|---|---|---|---|
| 3,341,052 | 9/1967 | Barthel | 220/14 |
| 3,358,867 | 12/1967 | Skinner | 220/14 |
| 3,438,115 | 4/1969 | Humphress et al. | 220/14 X |
| 3,698,589 | 10/1972 | Perry | 220/14 |
| 3,866,785 | 2/1975 | Conte | 220/14 X |

FOREIGN PATENT DOCUMENTS

| | | | |
|---|---|---|---|
| 93,180 | 2/1969 | France | 220/9 D |

*Primary Examiner*—Stephen Marcus
*Attorney, Agent, or Firm*—Young & Thompson

[57] ABSTRACT

This invention relates to containers for liquified gases, of the kind which comprise an inner container intended to hold the liquified gas which consists of a container body and an elongated neck, and an outer shell spaced away from the said inner container which forms with the latter an evacuated insulating space packed with material made up of successive superimposed layers of materials which are alternately conductive and insulating, marginal portions of the said layers of conductive material being in individual thermal contact, along annular areas spaced above one another, with the neck of the inner container, which extends to the said outer shell. According to the invention, the neck of the inner container is made from a plastics material, the thermal contact between the screening layers of conductive material and the neck being ensured by simple free contact under pressure. The inner container may be made from resin or glass, either of which may be reinforced by fibres.

7 Claims, 3 Drawing Figures

CONTAINERS FOR CRYOGENIC LIQUIDS

BACKGROUND OF THE INVENTION

The present invention relates to containers for cryogenic liquids, and in particular containers which have a high thermal insulating ability, to contain cryogenic liquids such as hydrogen, helium or neon which have a very low boiling point.

Containers of this kind generally comprise an inner container which is intended to hold the liquified gas and which consists of a body and an elongated neck, and an outer shell spaced away from the inner contaner which forms with the inner container an evacuted insulting space which contains a packing made up of successive superimposed layers of materials which are alternately conductive and insulating, marginal portions of the said layers of conducting material being in thermal contact with transverse annular areas around the said neck of the inner container. Hereinafter such containers will be referred to as "of the kind described". Thus, by recovering the sensible heat of the evaporating gas, as complete as possible an action can be achieved by which outwards thermal transfer is reduced as a result of the setting up of a suitable thermal gradient along the neck and, by virtue of the thermal connections to the neck, in the insulating space where the various layers of conductive material are situated. To allow these interstitial layers of highly conductive material to be cooled down, it has been found necessary to take deliberate steps to ensure excellent contact with the neck of the container, which is effected by making brazed joints between the neck, which is generally made of stainless steel, and the conductive layers, which are generally made of copper or aluminium. Given that there is a very large number of conductive layers, there being for example several tens of them in the case of a 100 litre container having a neck 30 cm long, and given that the soldered and brazed joints take a very long time to make and need great care, the procedure has been adopted of simply crimping copper flanges onto the neck, these flanges having at their peripheries a raised edge against which the margin of a layer of conductive material is clamped mechanically by means of a collar or the like. Such copper flanges, being firmly secured to the neck of the inner container, perform the dual function of ensuring both an excellent thermal contact between the neck and the conductive layers and that the connections between the neck and the layers of conductive material are spaced above one another in a suitable way to prevent any danger of thermal short circuits between the said layers along the neck, the effect of which would be to increase considerably the thermal flux conducted along the neck, which is made of a material which is rather poor conductor, as stainless steel is. However, this technique has the drawback that the neck, although made of stainless steel and thus a poor conductor, nevertheless still exhibits an excessively high thermal conductivity, so that losses are far from negligible. Also, stainless steel is an expensive material.

It has been proposed in the case of certain containers of lower performance which are intended to contain liquids, such a liquid argon or nitrogen, having higher boiling points, in which containers have evacuated insulating space between the inner container and the outer shell contains a packing formed from successive layers of material which are alternately reflective and insulating, with no thermal connections to the neck, that the neck of the inner container be made from a plastic material such as an epoxy resin, reinforced with glass fibres if necessary, the neck thus being suitably strong mechanically to withstand the considerable strains which are exerted on it owing to the fact that as part of the inner container it is also used, to a greater or lesser extent, as a member for suspending the inner container from the outer shell. Such strains are set up when the inner container is being filled and are increased by the contraction effects resulting from cooling down. However, attempts to adapt this technique of producing the neck which is employed in containers of lower performance intended to contain liquids at relatively high temperatures to containers of the kind described above, intended to contain liquids at very low temperatures (i.e. which incorporate, inter alia, layers of conductive material thermally connected to the neck) have so far been defeated by various difficulties. The most critical of these is the apparent impossibility of transferring to the screening layers of conductive material through a material which is far more insulating than stainless steel (its conductivity is 30 times lower), a thermal cooling flux which is as great as in conventional containers in which the greatest possible advantage is taken on the hand of the recovery of the sensible heat of the vapour which is continually released through the neck, by forming the neck from stainless steel which provides adequate transverse conduction for this purpose, and on the other hand of a certain leakage of thermal flux resulting from longitudinal conduction through the solid material of the neck from the body of the inner container to the mouth of the neck which is situated near the outer shell. It might in fact be feared that to ensure a suitable transfer of thermal flux it would be absolutely essential to set up special thermal bridges through the body of the plastics material which terminated inside the neck in direct contact with the vapour, which would complicate production to an enormous extent and would render it prohibitive.

The present invention has an object a container of simple construction which combines the beneficial effects on the one hand of a neck made of plastics material from the points of view of economy and strength, and on the other hand of good cooling of the screens of conductive material which enables radiation losses to be reduced to a minimum.

SUMMARY OF THE INVENTION

To achieve the above and further objects which will become apparent from a perusal of what is to follow, the invention consists in a container of the kind described wherein, the neck of the inner container is made of plastics material such as resin or glass which, if desired, is reinforced with fibres, and thermal contact between the screening layers of conductive material and the said neck is ensured simply by free contact under pressure. Trials which have been carried out have shown that such an arrangement, which from the thermal point of view, is extremely favourable to reducing outwards conduction along the body of the neck is fully satisfactory as regards the transfer, transversely to the neck, of a thermal flux derived from the vapour escaping through the neck, which flux can be distributed to the various conductive screening layers despite a slight variation in temperature at the points where the layers of conductive material press against the neck.

BRIEF DESCRIPTION OF THE DRAWINGS

In order that the invention may be more clearly understood, reference will now be made to the accompanying drawings, which show certain embodiments thereof by way of example and in which.

DETAILED DESCRIPTION OF PREFERRED EMBODIMENTS

Figure 1:
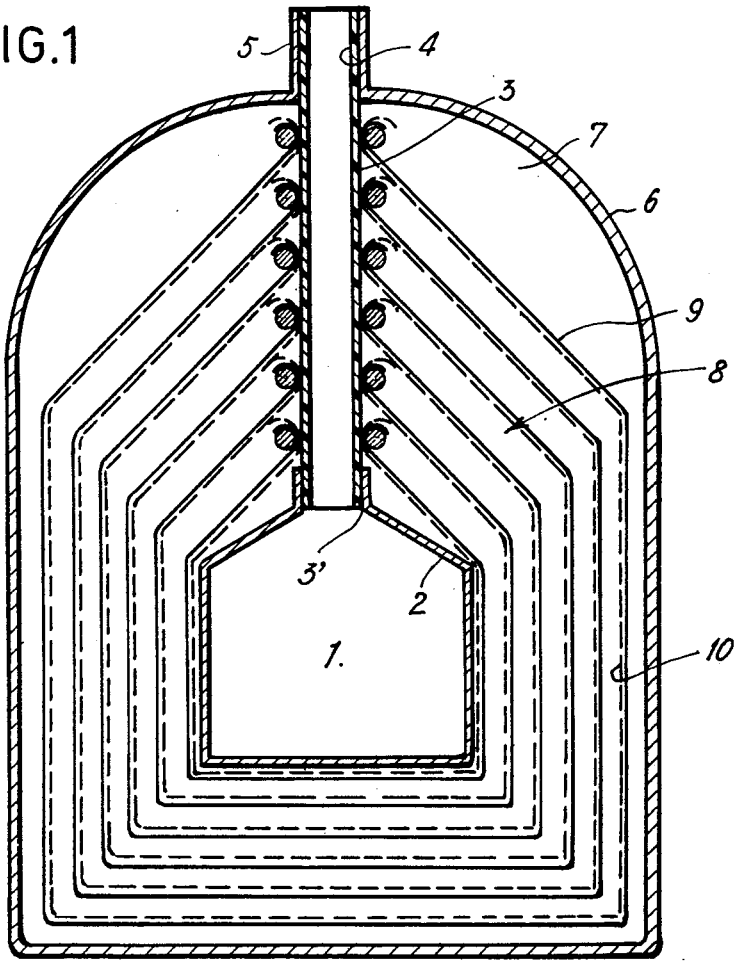
FIG. 1 is a schematic cross-section of a first embodiment of a container according to the invention.
Figure 2:
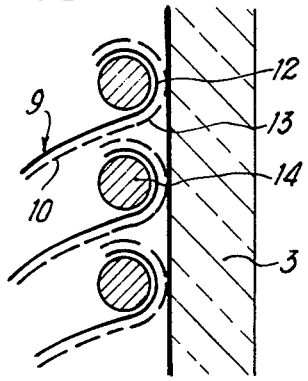
FIG. 2 is an enlarged view of a detail of FIG. 1.

Referring to FIGS. 1 and 2, the container therein shown is formed by an inner container 1 consisting of an aluminium body 2 and a container neck 3 made of an insulating material which is bonded at 3' to the body 2. By the upper end 4 of its neck 3, the inner container 1 is fixed in an annular collar 5 arranged at the upper end of a shell 6 of stainless steel which forms an outer container and, in conjunction with the inner container 2, creates an intervening, evacuated insulating space 7 in which is housed a packing 8 of screening layers which are formed alternately from a conductive material, such as aluminium foils 9, and an insulating material such as sheets of paper 10.

The inner container 1 may be made from resin or glass either of which may be reinforced with fibres if desired.

The aluminium foils 9, which are 9 microns thick for example, each have a marginal portion 12 which is pressed against the cylindrical outer face of the neck 3, with a marginal portion 13 of a sheet of paper 10 interposed, by the pressing action of a ring 14 which may be a spring, a metal wire tightened with pliers, a rubber band, a collar, or any part which will apply pressure to the edge 12 of the layer 9. It will be noted that the interposition of the layer of paper 10 is a sure way of guaranteeing thermal insulation between two adjoining conductive layers 9.

Figure 3:
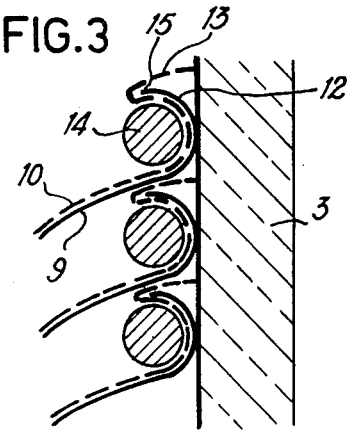
FIG. 3 is a view similar to FIG. 2 of a second embodiment.

In FIG. 3, an insulating layer 10 is interposed between a gripping ring 14 and a conductive layer 9 and, to ensure thermal insulation between pairs of adjoining conductive layers, the step has been taken of folding the marginal portion 13 of an insulating layer 10 around an edge 15 of a marginal portion 12 of a conductive layer 9.

Examples of insulating materials which may be used to form the neck of the container are a glass/epoxy laminate whose thermal conductivity at low temperatures is $1.05 \times 10^2$ watts per meter (W. $m^{-1}$) or nylon whose thermal conductivity is $0.895 \times 10^2$ W. $m^{-1}$.

From the thermal point of view the embodiments shown in FIGS. 2 and 3 give substantially equal results. In both cases, with for example a 34 liter container having a neck whose inside diameter is 50 mm, whose thickness is 1 mm, and whose useful length is 280 mm, and with 20 screening layers, the evaporation losses experienced are 2% per day, which is a better performance than that of conventional containers having stainless steel necks.

I claim:

1. In a container for liquified gases, which comprises an inner container to hold the liquified gas, said inner container comprising a container body and an elongated neck, and an outer shell spaced away from the said inner container, said shell forming with said inner container an evacuated insulating space packed with material made up of superimposed pairs of layers of materials, each pair of layers consisting of a conductive foil and an insulating sheet, marginal portions of each pair of layers being in individual thermal contact with the neck of the inner container along annular areas spaced from one another along said neck, said neck extending to said outer shell; the improvement in which the neck of the inner container is made from a plastic material, the said thermal contact between each pair of layers and the neck being achieved by means of an annular part which presses said marginal portion of each pair of layers directly onto said neck.

2. A container according to claim 1, wherein the insulating sheet of each pair of layers is in direct contact with said neck.

3. A container according to claim 1, wherein the conductive foil of each pair of layers is in direct contact with said neck, while the marginal portion of the insulating sheet is folded back around the edge of marginal portion of said foil of conductive material.

4. A container according to claim 2, wherein said annular part which provides the contact under pressure between the marginal edges of a pair of layers and said neck of the inner container is formed by a collar, which is tightened up on itself.

5. A container according to claim 4, wherein said collar is resilient.

6. A container according to claim 5, wherein said resilient collar is made of metal wire.

7. A container according to claim 5, wherein said resilient collar consists of a metal spring.

* * * * *